US005162764A

United States Patent [19]

Saso et al.

[11] Patent Number: 5,162,764

[45] Date of Patent: Nov. 10, 1992

[54] SLIM-TYPE POLARIZED ELECTROMAGNETIC RELAY

[75] Inventors: Hirofumi Saso, Komoro; Masayuki Matsumoto, Saku, both of Japan

[73] Assignee: Takamisawa Electric Co., Ltd., Tokyo, Japan

[21] Appl. No.: 717,597

[22] Filed: Jun. 19, 1991

[30] Foreign Application Priority Data

Jun. 20, 1990 [JP] Japan ..... 2-64473[U]

[51] Int. Cl.[5] ..... H01H 51/22

[52] U.S. Cl. ..... 335/78; 335/128; 335/202

[58] Field of Search ..... 335/78-85, 335/124, 128-130, 202

[56] References Cited

U.S. PATENT DOCUMENTS 3,993,971 11/1976 Ono et al. ..... 335/78

4,843,360 6/1989 Yoshino et al. .

FOREIGN PATENT DOCUMENTS 63-22054 2/1988 Japan .

*Primary Examiner*—Lincoln Donovan

*Attorney, Agent, or Firm*—Armstrong & Kubovcik

[57] ABSTRACT

A relay includes a base block (A'), an armature block (B') having a pair of armatures (8*a*, 8*b*) and a permanent magnet (17*a*, 17*b*), and an electromagnet block (C') having an approximately U-shaped core (10). Magnetic pole legs (18*a*, 18*b*) of the electromagnet block are inserted through the armatures into the base block, to thereby sandwich the armature block between the base block and the electromagnet block.

4 Claims, 4 Drawing Sheets

SLIM-TYPE POLARIZED ELECTROMAGNETIC RELAY

BACKGROUND OF THE INVENTION

1) Field of the Invention

The present invention relates to a slim-type polarized electromagnetic relay used in a communication system and the like.

2) Description of the Related Art

There are two kinds of electromagnetic relays: a slim-type and a flat-type. The slim type requires a less occupied area rather than a smaller height, while the flat-type requires a smaller height rather than a less occupied area.

In the prior art, however, the two kinds of electromagnetic relays are constructed by individual parts specialized to each kind, and as a result, the expense of manufacturing the two kinds of electromagnetic relays is high, and thus the manufacturing cost is increased.

SUMMARY OF THE INVENTION

Therefore, an object of the present invention is to reduce the manufacturing cost of electromagnetic relays.

According to the present invention, a relay includes a base block, an armature block having a pair of armatures and a permanent magnet, and an electromagnet block having an approximately U-shaped core. Magnetic pole legs of the electromagnet block are inserted through the armatures into the base block, thereby sandwiching the armature block between the base block and the electromagnet block. That is, the slim-type electromagnetic relay according to the present invention has a large number of components commonly used in a flat-type electromagnetic relay.

BRIEF DESCRIPTION OF THE DRAWINGS

The present invention will be more clearly understood from the description as set forth below, with reference to the accompanying drawings, wherein.

DESCRIPTION OF THE PREFERRED EMBODIMENT

Before the description of an embodiment of the present invention, a prior art flat-type electromagnetic relay will be explained with reference to FIGS. 1 and 2.

Figure 1:
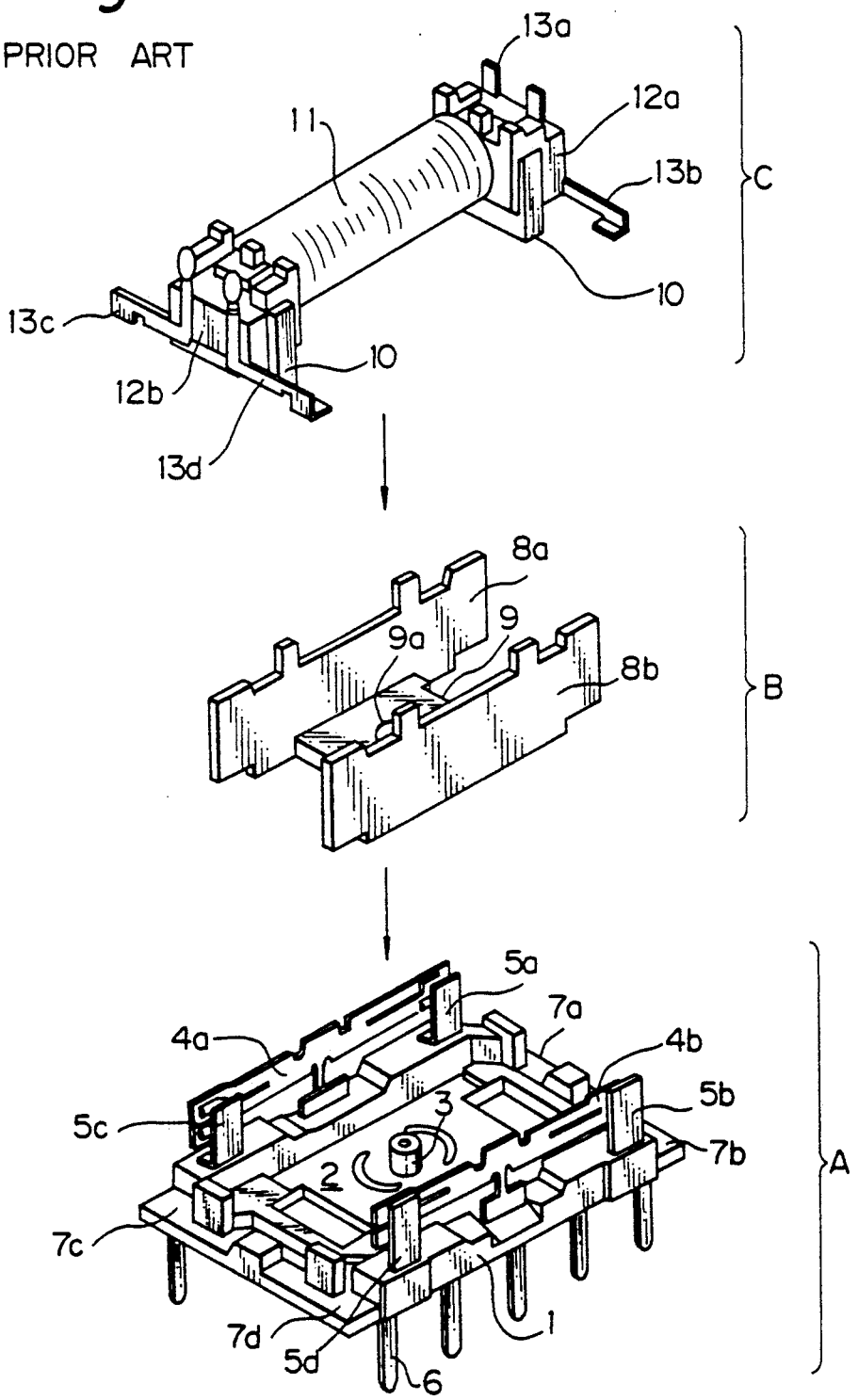
Fig. 1 PRIOR ART
FIG. 1 is an exploded, perspective view illustrating a prior art flat-type polarized electromagnetic relay.

In FIG. 1, which is an exploded, perspective view, reference A designates a base block, B an armature block, and C an electromagnet block.

The base block A includes a base 1 made of synthetic resin provided with a recess 2, and a stud 3 for supporting the armature block B is protruded from a center of the recess 2 of the base 1. Also, movable contact springs 4*a* and 4*b*, and stationary contact springs 5*a*, 5*b*, 5*c*, and 5*d*, which oppose the ends of the movable contact springs 4*a* and 4*b*, are inserted into the base 1 by molding. Further, reference numerals 6 designate terminals connected to the movable contact springs 4*a*, 4*b*, the stationary contact springs 5*a*, 5*b*, 5*c*, and 5*d*, and winding terminals 13*a*, 13*b*, 13*c*, and 13*d*. Also, reference numerals 7*a*, 7*b*, 7*c*, and 7*d* designate winding terminal coupling portions for the winding terminals 12*a*, 12*b*, 12*c*, and 12*d*, respectively.

The base block B includes a pair of parallel armatures 8*a* and 8*b*, and a coupling member 9 including a permanent magnet for coupling the armatures 8*a* and 8*b* to each other.

The electromagnet block C includes an approximately U-shaped core 10 on which a winding 11 is wound, and collars 12*a* and 12*b* on which the winding terminals 13*a* through 13*d* are mounted.

The armature block B is mounted on the base block A by inserting the stud 3 thereof into a hole 9*a* of the coupling member 9 of the armature block B. Then, the electromagnet block C is mounted on the armature block B, so that the core 10 is interposed between the armatures 8*a* and 8*b*, whereby an assembled state of the relay of FIG. 1 is obtained as illustrated in FIG. 2. Note that reference numerals 14*a* and 14*b* designate cards for coupling the movable contact springs 4*a* and 4*b* to the armatures 8*a* and 8*b*, respectively.

Figure 2:
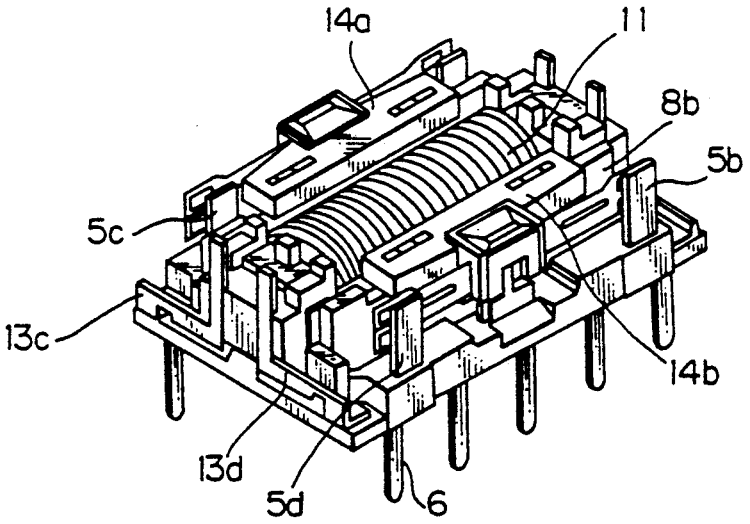
Fig. 2 PRIOR ART
FIG. 2 is a perspective view of an assembled state of the relay of FIG. 1.

The above-mentioned flat-type electromagnetic relay of FIGS. 1 and 2 is not suitable for a slim-type relay, and further, a prior art slim-type electromagnetic relay is constructed by different parts of such a flat-type electromagnetic relay as shown in FIGS. 1 and 2 (see: U.S. Pat. No. 4,843,360), thus increasing the manufacturing cost.

In the present invention, most of the parts of the flat-type electromagnetic relay of FIGS. 1 and 2 are used.

Figure 3:
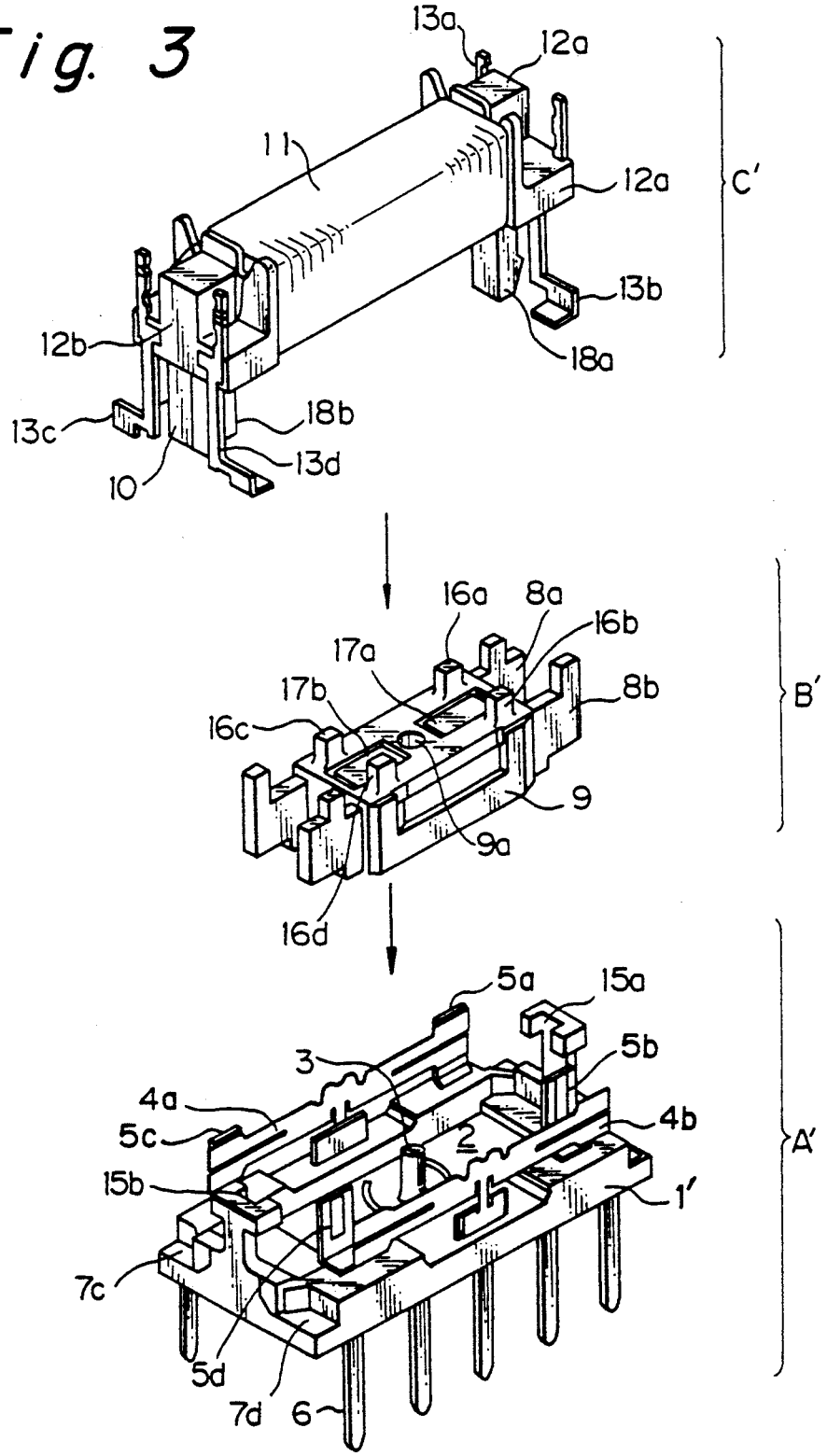
FIG. 3 is an exploded, perspective view illustrating an embodiment of the slim-type polarized electromagnetic relay according to the present invention.

In FIG. 3, which is an exploded, perspective view of the slim-type electromagnetic relay according to the present invention, a base block A′ is similar to the base block A of FIG. 1, but a base 1′ is slimmer than the base 1 of FIG. 1. Also, fitting grooves 15*a* and 15*b* are provided at both ends of the base 1′, to allow magnetic pole legs 18*a* and 18*b* to be inserted therein.

An armature block B′ is similar to the armature block B of FIG. 1, except that protrusions 16*a*, 16*b*, 16*c*, and 16*d* are provided on four ends of the coupling member 9. This coupling member 9 is made by molding the armatures 8*a* and 8*b* to keep them in parallel with each other. Also, reference numerals 17*a* and 17*b* designate permanent magnets.

An electromagnet block C′ is also similar to the electromagnet block C of FIG. 1, except that the magnetic pole legs 18*a* and 18*b* of the U-shaped core 10 are longer than those of FIG. 1 (not shown), and can reach the fitting grooves 15*a* and 15*b* of the base block A′.

Figure 4:
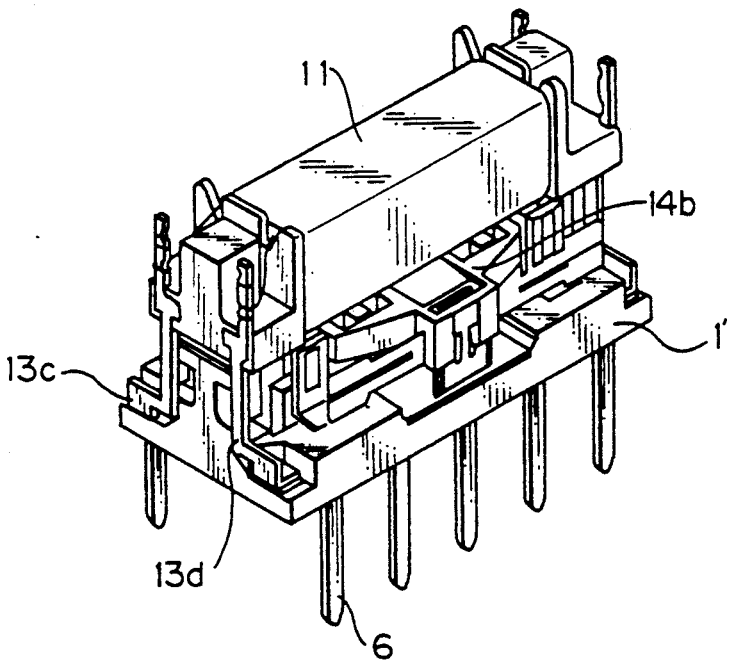
FIG. 4 is a perspective view of an assembled state of the relay of FIG. 3.

The blocks A′, B′, and C′ of FIG. 3 are assembled to obtain a state as illustrated in FIG. 4. That is, the armature block B′ is mounted on the base block A′ by inserting the stud 3 thereof into the hole 9*a* of the coupling member 9. Also, the protrusions 16*a* through 16*d* of the coupling member 9 are associated by the cards 14*a* and 14*b* with the central upper portions of the movable contact springs 5*a* and 5*b*. Further, the electromagnet block C′ is placed above the armature block B′ and the base block A′, by inserting the magnetic pole legs 18*a* and 18*b* into the fitting grooves 15*a* and 15*b* of the base block A′, and as a result, the faces of the magnetic pole legs 18*a* and 18*b* oppose the faces of the armatures 8*a* and 8*b*. Also, the winding terminals 13*a* through 13*d*, which are made, for example, by an insert-molding into the collars 12*a* and 12*b*, are adhered by a spot-welding to the winding terminal coupling portions 7*a*, 7*b*, 7*c*, and 7*d* of the base block A'. Thus, the armature block B' is sandwiched by the base block A' and the electromagnet block C', as illustrated in FIG. 4.

The operation of the relay of FIGS. 3 and 4 will be explained below.

When the winding 11 is not excited, a magnetic circuit is formed by only the permanent magnets 17*a* and 17*b*. That is, a magnetic flux generated from the permanent magnets 17*a* and 17*b* is absorbed by one end of the armature 8*a* and one end of the armature 8*b* which are in contact with the faces of the magnetic pole legs 18*a* and 18*b*. As a result, the movable contact spring 4*a* is in contact with one of the stationary contact springs 5*a* and 5*c*, while the movable contact spring 4*b* is in contact with one of the stationary contact springs 5*b* and 5*d*. This state is maintained until the winding 11 is excited.

Next, when the winding 11 is excited by supplying a current thereto, to generate a magnetic flux opposite to the magnetic flux in the core 10 by the permanent magnets 17*a* and 17*b*, the faces of the magnetic pole legs 18*a* and 18*b* and the armatures 8*a* and 8*b* repulse and attract each other at the stud 3, so that the armatures 8*a* and 8*b* are rotated at the stud 3. As a result, the closed contacts where the movable contact springs 4*a* and 4*b* are in contact with the stationary contact springs such as 5*a* and 5*b*, are opened, and the opened contacts where the movable contact springs 4*a* and 4*b* are in contact with the stationary contact springs such as 5*c* and 5*d* are closed, thus carrying out a switching operation. Thereafter, when the excitation of the winding 11 is released, the switched state of the relay is maintained by the magnetic flux of the permanent magnet 17*a* and 17*b* in the case of a latch type. Note, in the case of a non-latch type, the relay is returned by the return force of the movable contact springs 4*a* and 4*b* and nonmagnetic plates on a face to be in contact with the magnetic pole faces of the armatures 8*a* and 8*b* to a state before the winding 11 is excited.

Also, in the latch type, when the winding 11 is again excited in the reverse direction, the relay returns to its original state. Here, two cases exist: a case wherein the winding 11 is excited in both the positive and negative directions, and a case wherein the winding 11 is split into two portions which are excited in the positive direction and in the negative direction, respectively.

As explained above, according to the present invention, since the electromagnet block C' is arranged above the armature block B', the width of the relay can be remarkably reduced to obtain a super slim type, compared with the case where the electromagnet block C is arranged between the pair of armatures.

Also, since the armatures, the movable contact springs, the stationary contact springs, and the cards of the flat-type electromagnetic relay of FIGS. 1 and 2 can be commonly used, the slim type relay according to the present invention can be economically manufactured. Further, since the pair of armatures are molded by synthetic resin in a body into the armature block, and the axis hole of the armature block is supported by the stud at the center of the base block, the relationship of the position of the pair of armatures can be precisely arranged.

While the invention has been particularly shown and described n reference to preferred embodiments thereof, it will be understood by those skilled in the art that changes in form and details may be made therein without departing from the spirit and scope of the invention.

We claim:

1. A relay comprising:

a base block (A') having a base (1'), a supporting stud (3) protruded from a center of a recess portion (2) of said base, and protruding members extending from said base on both sides thereof and having fitting grooves (15*a*, 15*b*);

an armature block (B') having a pair of armatures (8*a*, 8*b*), a coupling member (9) for coupling said armatures in parallel with each other, and at least one permanent magnet (17*a*, 17*b*), between said armatures, said coupling member having a hole (9*a*) at the center thereof, siad armature block being rotatably supported on said base block by inserting said studs of said armature block into said hole of said block; and an electromagnet block (C') having a substantially U-shaped core (10) including two magnetic pole legs (18*a*, 18*b*) on both sides thereof, a winding (11) wound on said core, and terminals connected to said winding, said magnetic pole legs of said electromagnet block being inserted through said armatures into said fitting grooves of said protruding members of said base to thereby sandwich said armature block between said base block and said electromagnet block.

2. A relay as set forth in claim 1, wherein said armature block has substantially the same width as said electromagnet block.

3. A relay as set forth in claim 1, wherein said coupling member is made by molding said armatures to keep them in parallel with each other.

4. A relay as set forth in claim 1, wherein said base block further includes:

a pair of movable contact springs (4*a*, 4*b*);

a pair of cards (14*a*, 14*b*) for coupling said movable contact springs to said armatures; and at least two stationary contact springs (5*a*, 5*b*) at opposite ends of said movable contact springs.

* * * * *